United States Patent [19]

Bennett, Jr.

[11] 4,184,293

[45] Jan. 22, 1980

[54] ROLL NECKREST SUPPORT

[75] Inventor: Robert G. Bennett, Jr., Seymour, Conn.

[73] Assignee: USM Corporation, Farmington, Conn.

[21] Appl. No.: 942,371

[22] Filed: Sep. 14, 1978

Related U.S. Application Data

[63] Continuation of Ser. No. 834,049, Sep. 16, 1977, abandoned.

[51] Int. Cl.[2] ..... B24B 41/06

[52] U.S. Cl. ..... 151/238 R; 51/49

[58] Field of Search ..... 51/236, 238 R, 238 S, 51/49

[56] References Cited

U.S. PATENT DOCUMENTS

| | | | |
|---|---|---|---|
| 2,000,608 | 5/1935 | Peaslee | 51/49 |
| 2,151,636 | 3/1939 | Flygare | 51/238 S |
| 2,730,843 | 1/1956 | Ernst | 51/238 R |
| 3,274,867 | 9/1966 | Sell | 51/238 S |
| 3,431,681 | 3/1969 | Flohr | 51/236 |

*Primary Examiner*—Harold D. Whitehead

*Attorney, Agent, or Firm*—Donald N. Halgren; Richard B. Megley; Vincent A. White

[57] ABSTRACT

A roll grinding machine having a neckrest which comprises a pair of roll supporting gibs functioning as independent load carrying members as well as having means for adjusting both the supporting gibs permitting accurate axial alignment of the roll in the machine.

5 Claims, 7 Drawing Figures

Fig. 2
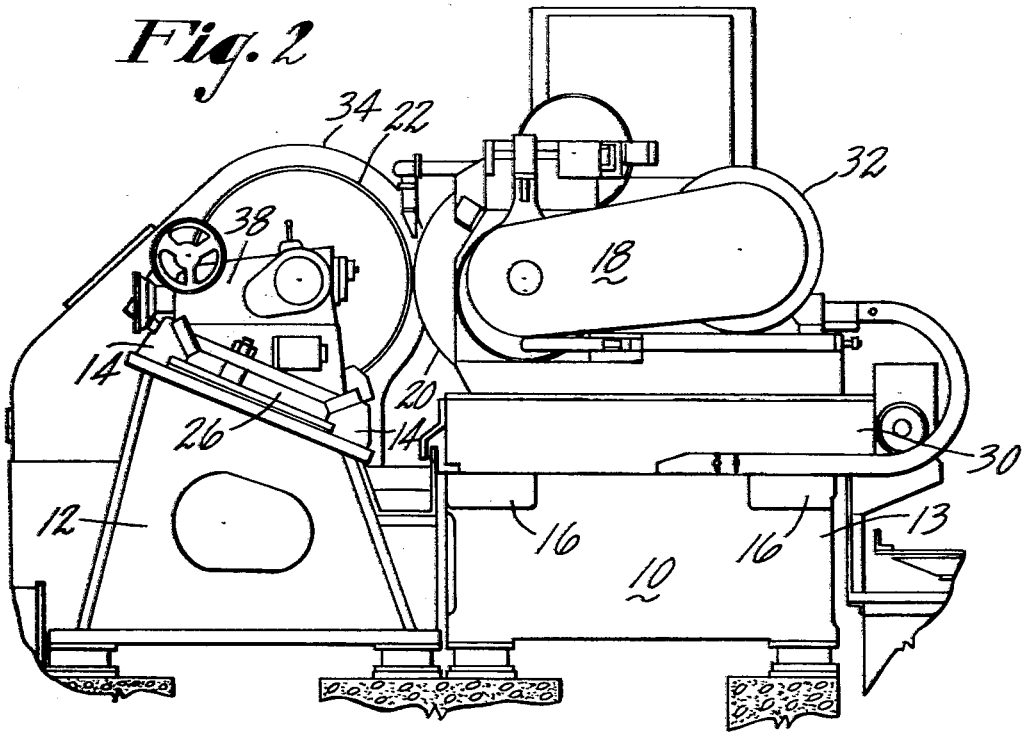
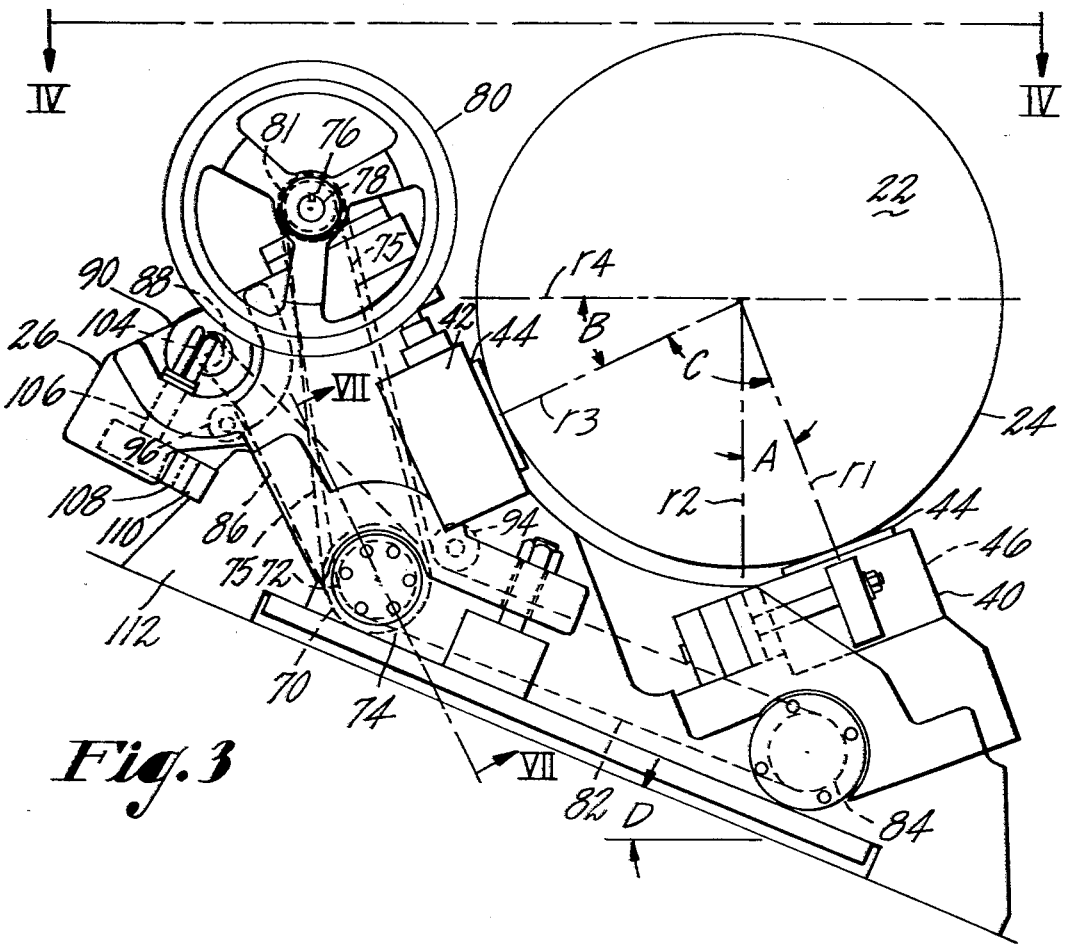
Fig. 3

ROLL NECKREST SUPPORT

This is a continuation of application Ser. No. 834,049, filed Sept. 16, 1977, and now abandoned.

BACKGROUND OF THE INVENTION

1. Field of the Invention

This invention relates to grinding machines and more particularly to neckrest supports for journals of rolls which are resurfaced in these machines.

2. Prior Art

Apparatus for grinding mill rolls generally comprises means in the form of neckrests or journal supports for rotatably supporting a roll to be ground, and a carriage means movable on ways along the length of the roll. The carriage carries thereon a grinding wheel on a sub-carriage which is movable toward and away from the face of the roll to position the grinding wheel with respect to the roll.

During usage a mill roll will experience wear along and across its face, and periodically such rolls must be reground to a predetermined shape or contour. When a roll is to be reground, it must be mounted in a grinding machine, each end of the roll comprising a neck or journal, which is supported on an arrangement of neckrests having gibs which provide a bearing surface for the journal.

Neckrest supports and their associated mechanisms of the prior art are exemplified by U.S. Pat. Nos. 3,430,400 to A. T. Parrella et al, and 3,456,395 to A. T. Parrella, both assigned to the assignee of the present invention. The neckrest depicted therein comprises a base portion and a movable arm portion pivoted to the base portion. The base and arm portions each comprise a gib which includes a bearing surface therewith. The side gib had its bearing surface disposed in the horizontal plane adjacent the side of the roll, and movable thereagainst through an arrangement of levers, and motor driven gear mechanisms. The gibs transmit the load of the roll through the base and arm portion, then into the bedways of the machine, which is an indirect method to transfer the load of the roll supported thereon.

It is an object of the present invention to provide a support arrangement for the journal of a roll in a roll grinding machine, the support comprising movable gibs which are able to distribute the weight of the roll over a full portion of its base with a direct transfer of that weight from those support gibs to that base and provide stability in a positive manner.

It is another object of the present invention to provide a support arrangement which comprises bottom and side gibs which permit travel adjustments thereof for precision alignment corrections.

It is yet a further object of the present invention to provide a support arrangement for a roll, wherein the support is simpler, more economical to manufacture and more adjustably precise than that shown in the prior art.

BRIEF SUMMARY OF THE INVENTION

The present invention comprises a roll neckrest support for a roll grinding machine. Each neckrest provides the weight supporting functions for one end of the roll in the machine. Each support comprises an adjustable gib mechanism having stable structures which divide the load-bearing responsibilities. The gibs are adjustable through a set of interconnected gear mechanisms including a harmonic drive unit to permit accurate axial alignments of the roll with the machine.

BRIEF DESCRIPTION OF THE DRAWINGS

The objects and advantages of the present invention will become more apparent when viewed in conjunction with the following drawings, in which:

FIG. 2 is a view taken along the lines II—II of FIG. 1;

FIG. 3 is a view taken along the lines III—III of FIG. 1;

DESCRIPTION OF THE PREFERRED EMBODIMENT

Figure 1:
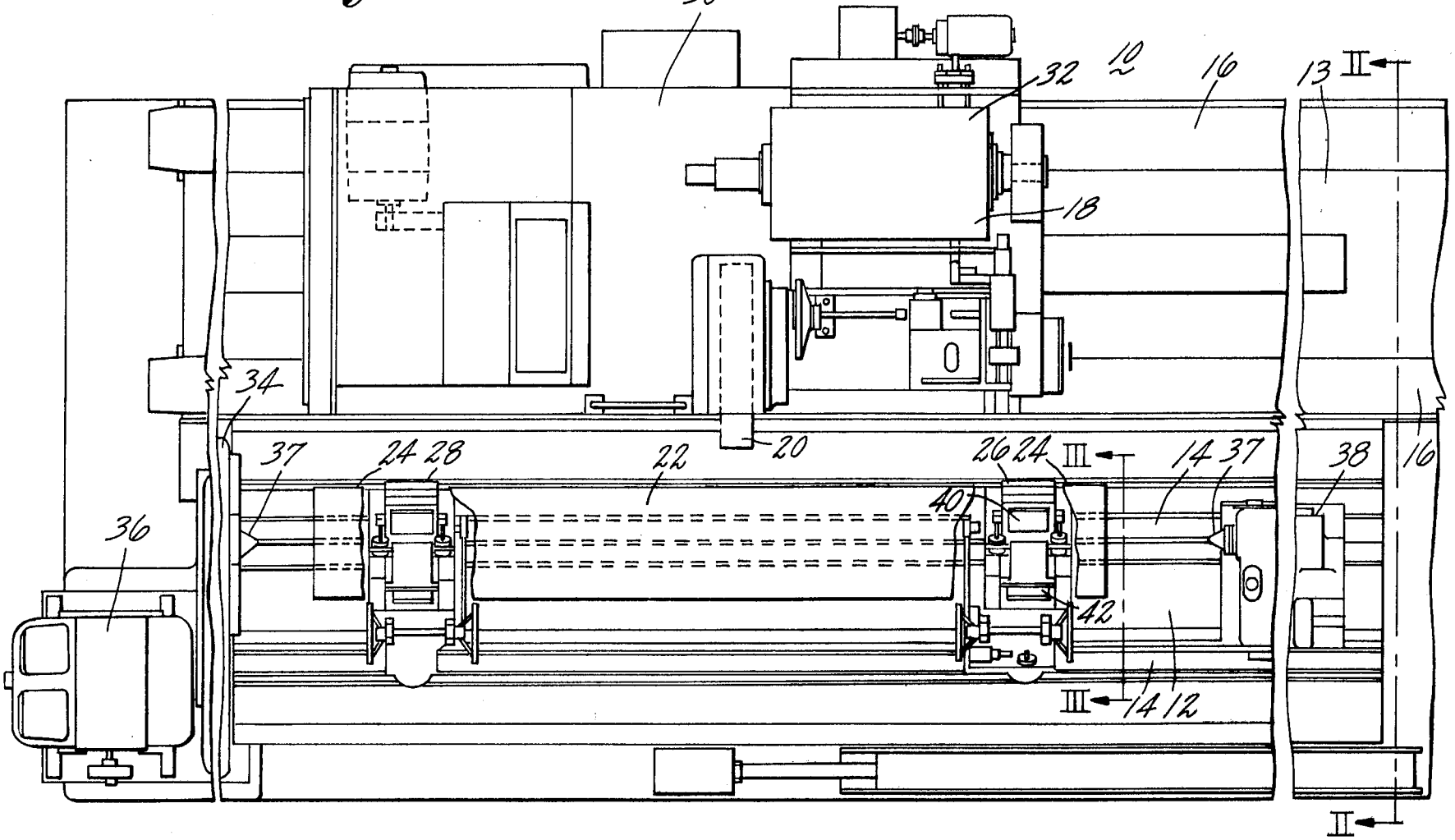
FIG. 1 is a plan view of a roll grinding machine constructed according to the principles of the present invention having a roll supported therewith.

Referring now to the drawings in detail, and to FIGS. 1 and 2 in particular, there is shown a roll grinding machine 10 comprising a front bed or frame member 12 and a back bed 13 each having an arrangement of parallel ways 14 and 16, respectively, thereon. A grinding wheelhead assembly 18 is movable in either direction along the ways 16. The grinding wheelhead assembly 18 includes a grinding wheel 20 operable upon a mill roll 22 shown in FIG. 1. The mill roll 22 has a journal or neck portion 24 at each end thereof, and is supported at each end by a neckrest or journal support 26 and 28. The grinding wheel 20 rotates against the surface of the roll 22 and is driven by a motor 32 mounted on a carriage 30. The roll 22, supported on the neckrests 26 and 28, is caused to rotate by a chuck arrangement, not shown, which is part of a headstock 34. The headstock 34 includes a drive motor 36 for turning the roll 22 through the chuck arrangement. The headstock 34 and a footstock 38 are both on the front bed 12, the footstock 38 being slidable on the front ways 14. The headstock 34 and the footstock 38 each have a roll center 37 which engages each end of the roll during initial stages of alignment thereof, prior to set up with the neckrest supports 26 and 28.

Figure 5:
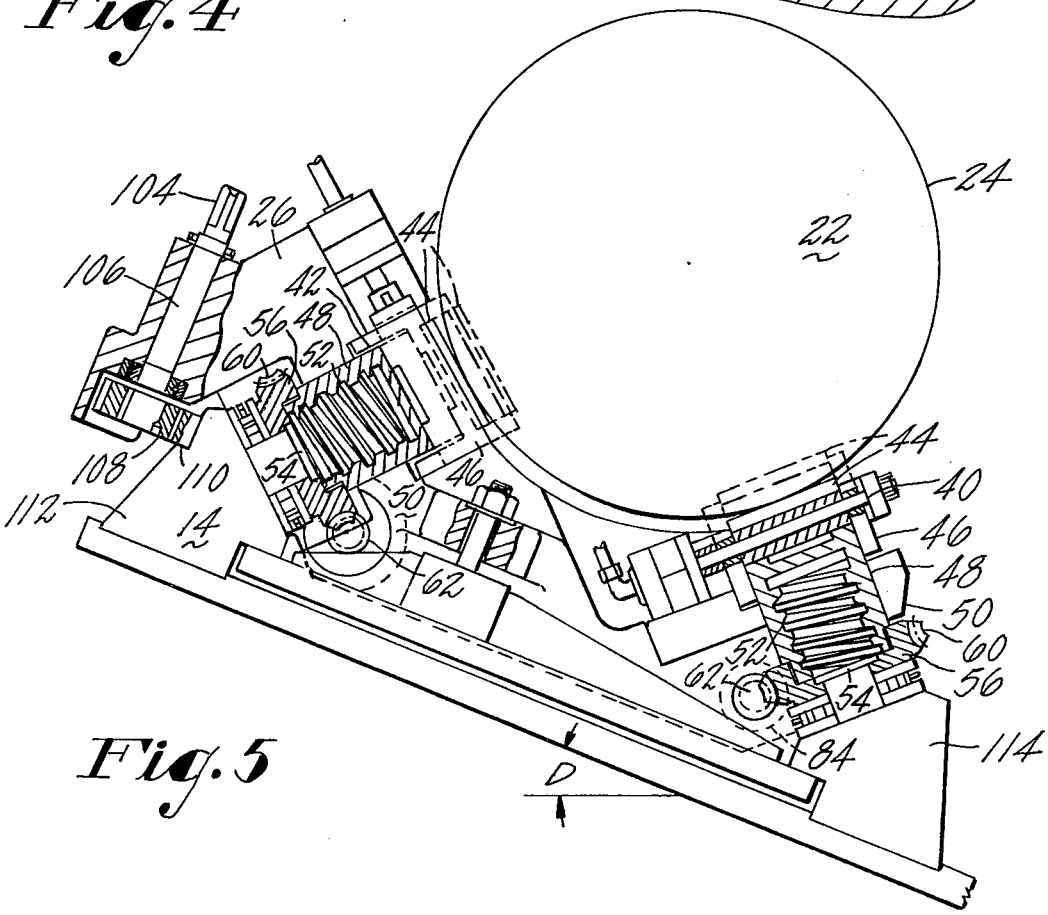
FIG. 5 is a view similar to FIG. 3, with portions removed and portions shown in section.
Figure 6:
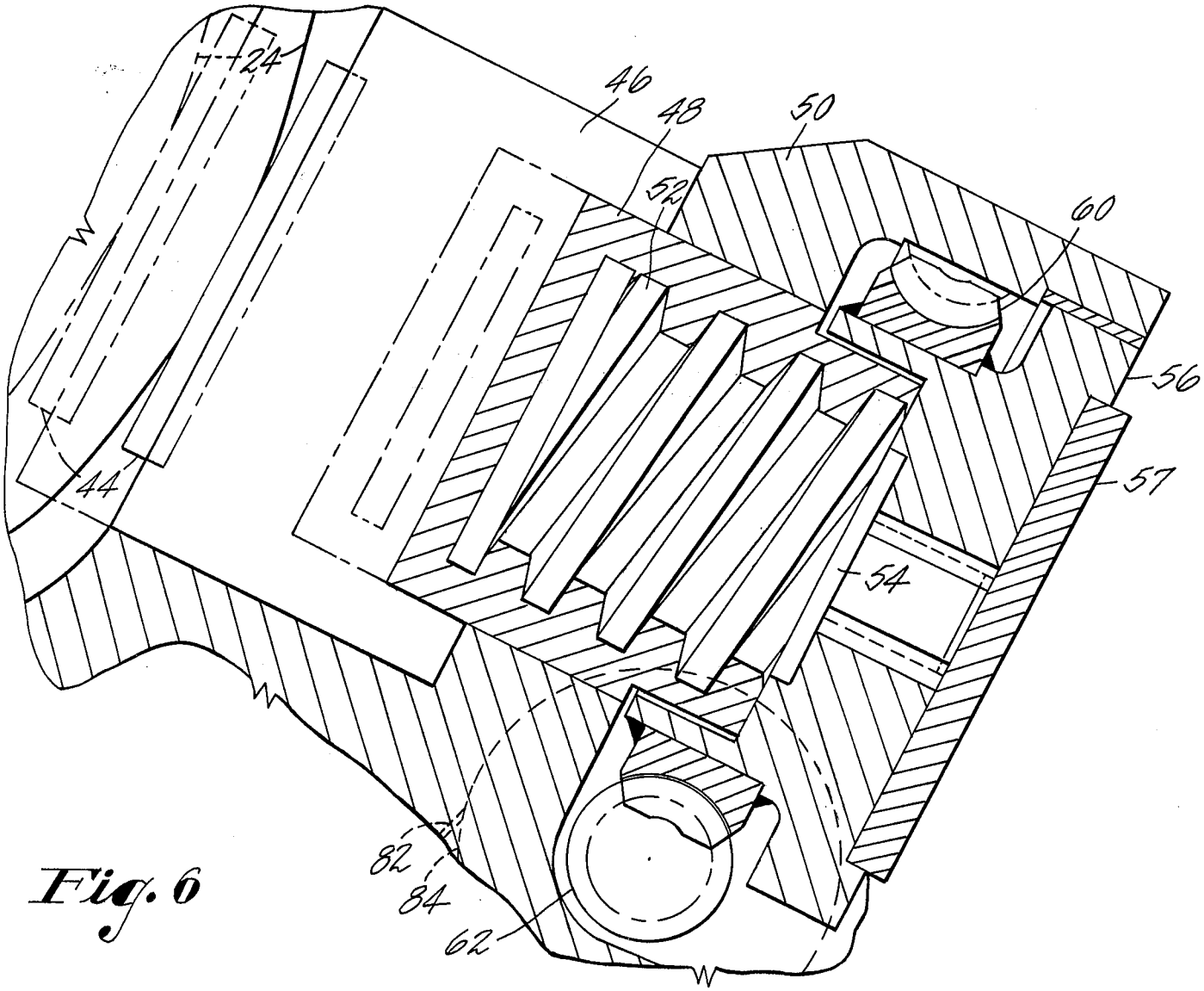
FIG. 6 is a view taken along the lines VI—VI of FIG. 4.

The neckrest support 26 nearest the footstock 38 is typical of both, and may be seen more clearly in FIG. 3. The journal 24 of the mill roll 22, when it is set up in the support 26, is disposed against a bottom gib 40 and a side gib 42. The gibs 40 and 42 are bearing blocks, preferably constructed from a Meehanite casting. Meehanite is a tradename of a processed iron of high strength which has both unusual wear resistance and high vibration-damping characteristics. Both gibs 40 and 42 have a babbit surface 44 which has an area, or line that is in actual engagement with the journal 24. The gibs 40 and 42 also comprise a housing 46 which is removably disposed about an adjacent screw housing 48, as shown in FIGS. 5 and 6. The gibs 40 and 42 are removable to permit their replacement, which is necessitated on occasion, by wear of any part thereof, or by changes of the diameter of any particular journal 24.

The screw housing 48 is keyed for longitudinal movement in a base unit 50. An adjusting screw 52 is rotatively disposed within the screw housing 48. The adjusting screw 52 has a lower end 54 which is fixedly attached to a rotatable drive member 56. The drive member 56 has a worm wheel 60 securedly fitted about a lower portion of its periphery. The drive member 56 turns against a thrust bearing arrangement 57. The drive member 56 and the worm wheel 60 are rotatively disposed within the base unit 50. A worm gear 62 is matingly engaged with the worm wheel 60.

Figure 7:
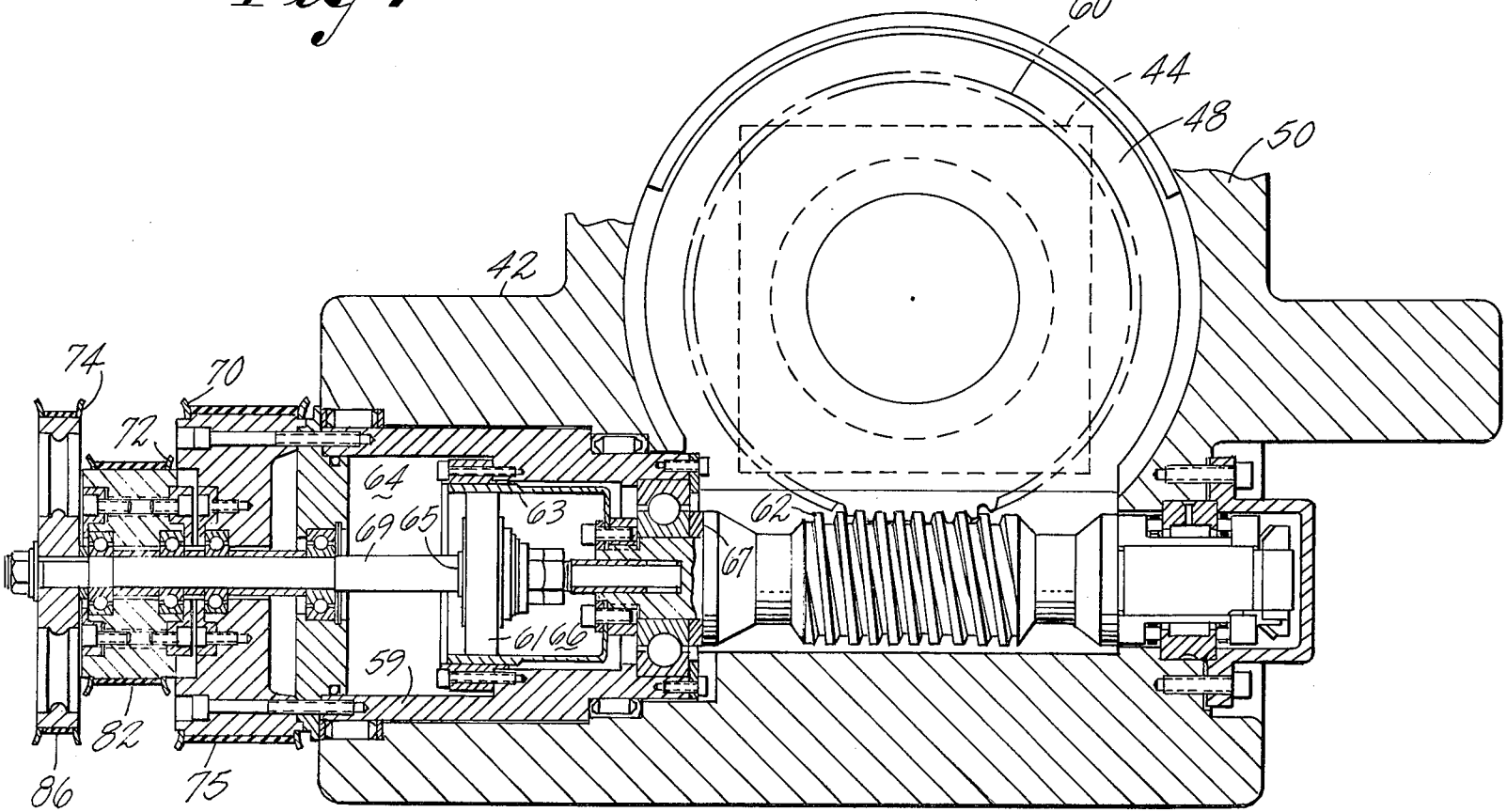
FIG. 7 is a view taken along the lines VII—VII of FIG. 3.

The worm gear 62 is attached to a reduction system 64 similar to that shown in FIG. 7. The reduction system 64 in the side gib 42, includes a harmonic drive unit 66 having an output end 67 which is connected through a proper bearing, to one end of the worm gear 62. The harmonic drive unit 66 has an input end 65 which is attached through a connecting shaft 69, to an array of pulleys 70,72 and 74, the first and third of which provide the input into the reduction system 64 and provide portions of the interconnecting linkage between the bottom and side gibs 40 and 42.

Figure 4:
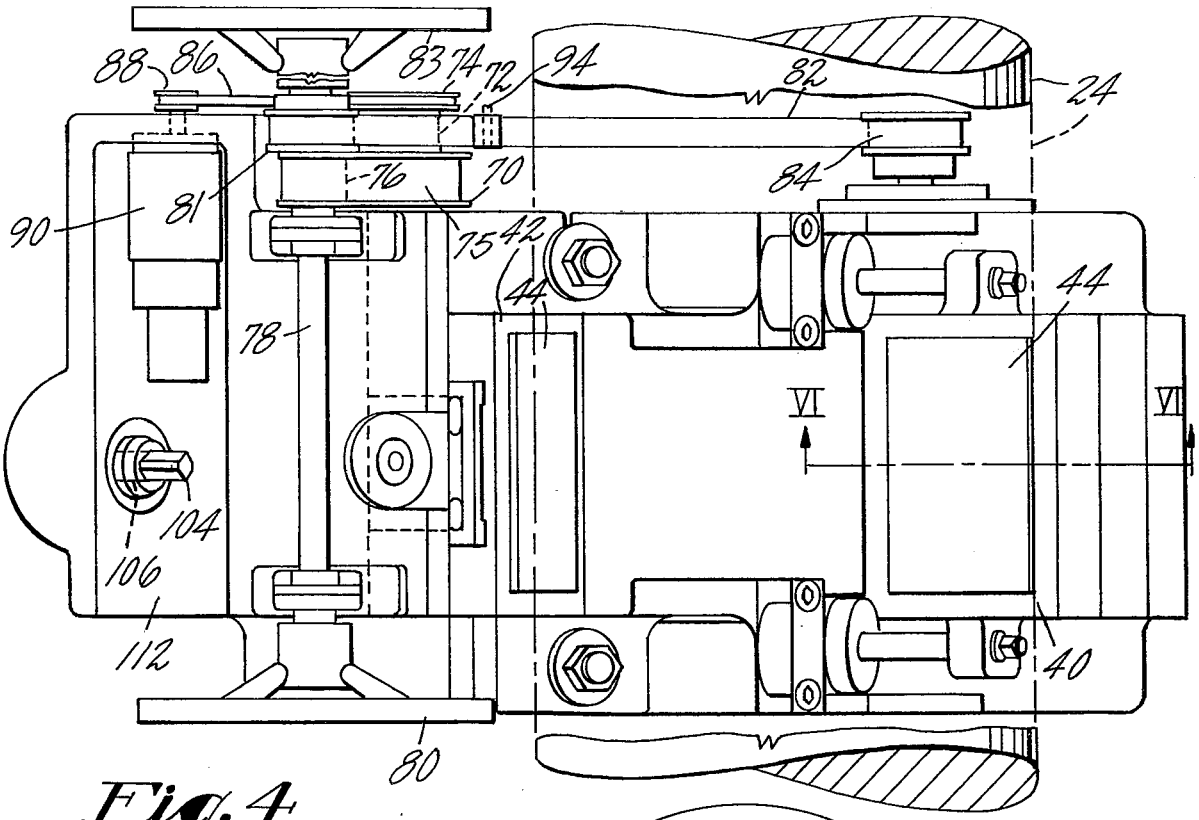
FIG. 4 is a view taken along the lines IV—IV of FIG. 3.

The pulleys 70, 72 and 74 are shown in cross-section in FIG. 7. The first pulley 70 is attached to a rotatable cylindrical housing 59 which rotates the worm gear 62 through the harmonic drive unit 66. The third pulley 74 is fixedly attached to the connecting shaft 69, is linked to the reduction system 64 via the connecting shaft 69 and harmonic drive unit 66, to the worm gear 62. The second pulley 72 is free wheeling with respect to the other two pulleys 70 and 74, and the shaft 69. The third pulley 74 is a fine adjustment pulley which is connected through a wave generator 61 and a flexspline 63 in the harmonic drive unit 66 to permit the transmition of reduced rotational motion to the worm gear 62 for the side gib 42. The first pulley 70 is operatively connected by a belt 75 to a pulley 76 attached to a handwheel shaft 78 keyed to and rotatively supporting a first handwheel 80, as shown in FIGS. 3 and 4. Rotation of the first handwheel 80 permits coarse radially directed adjustment of the side gib 42. The second pulley 72 operatively connects a belt 82 to a fourth pulley 81. The fourth pulley 81 is fixedly attached to a second handwheel 83. The second handwheel 83 and a fourth pulley 81 is rotatively supported on the shaft 78. Rotation of the second handwheel 83 and hence the fourth pulley 81 permits coarse adjustment of the bottom gib 40 through the belt 82 which is disposed about a corresponding pulley 84 on the bottom gib 40. The fine adjustment (third) pulley 74 is connected through a flexible belt 86 to a pulley 88 on the shaft of a motor 90. The flexible belts 82 and 86 are each kept taut by idler wheels 94 and 96, articulated therewith, respectively.

A wrench adaptor 104 is shown comprising the distal end of a shaft 106 connected to a pinion gear 108. The shaft 106 rotatably extends through a bore in the base portion of the neckrest support 26, as shown in FIGS. 3, 4 and 5. The pinion gear 108 is engaged with a rack 110 which is integral with an inverted-V way 112, and which comprises a portion of the way 14 upon which the neckrest support 26 slides. The bottom gib 40 of the neckrest support 26 also slides upon a second inverted-V way 114, that additionally comprises the way 14. The way 14 is disposed at an angle D with respect to the front bed 12, as shown in FIGS. 3 and 5. The angle D having a range of from about 18°-25°, preferably 23°.

The bottom gib 40 has a similar housing 46 and screw adjusting arrangement as the side gib 42 but it has only a single pulley 84, as shown in FIG. 4, which is connected directly with the screw adjusting arrangement. The flexible drive belt 82 for the bottom gib 40 extends between the pulley 84 on the bottom gib, to the idler wheel 94 and around the second pulley 72, to the fourth pulley 81 which is not keyed to the handwheel shaft 78.

The bottom gib 40 and the side gib 42 are each mounted for movement in the neckrest support 26 along the longitudinal axis of their respective adjusting screws 52. The babbit surface 44 of each gib 40 and 42, each define a plane which is normal to a given intersecting radius of the journal 24 as shown in FIG. 3. The angle between a radius line r1 of the journal 24 intersecting the contact area of the babbit 44 of the bottom gib 40 and the vertical radius line designated r2, comprises an angle A having a range of from about 15°-25°, preferably 20°. The contact area of the babbit 44 of the side gib 42 has an imaginary normal line of intersection with the horizontal plane r4, which through the rotational axis of the journal 24 forms an angle B with the horizontal, the angle B being in a range of from about 20°-30° below the horizontal plane, preferably 25° below the horizontal plane r4, which also bisects the journal 24. That is, the radii of the journal 24 that are normal to the side and bottom gibs 40 and 42, define an arc C of about 80°-90°, preferably 85°. This "spread" of the side and bottom gibs 42 and 40, away from the horizontal and vertical planes, respectively, permits the grinding forces to be more effectively transferred to the front bedway 14. This angular distribution of the gibs 40 and 42 prevents the backlash and misadjustment of the various sizes of rolls which has been a problem when they were supported on prior art neckrests. Additionally, the side and bottom gibs 42 and 40, each provide a direct linear load bearing path which is normal to their corresponding load bearing surfaces on their respective ways 112 and 114, to further provide stability for the loads they bear.

In operation, the gibs 40 and 42, of the neckrest support 26 may be adjusted toward or away from the rotational axis of the machine 10, permitting the neckrest 26 to adapt a wide range of journal diameters, merely by turning the first handwheel 80 or the second handwheel 83. Rotation of the first handwheel 80 turns the handwheel shaft 78 and pulley 76 attached thereto, moving the belt 75, causing pulley 70 in the side gib 42 to turn the worm gear 62 through its linkages. The worm gear 62 in turn rotates the worm wheel 60 and its adjusting screw 52. The adjusting screw 52 rotates forcing the keyed adjusting screws housing 48 to move against (or away from) the housing 46 along its longitudinal axis, in turn forcing its associated babbit 44 against (or away from) the rotational axis of the machine, and hence, providing coarse alignment with the desired axis of rotation of the journal roll 22, at least with respect to the side gib 42. The rotation of the second handwheel 83 causes the fourth pulley 81 attached to it to rotate, imputing motion to the bottom gib drive belt 82, running adjacent the idler pulley, (the second pulley) 72. The flexible drive belt 82, as aforementioned also, connects the second pulley 72 with the pulley 84 on the end of the shaft attached to a similar worm gear for the bottom gib 40, causes a corresponding motion therewith, as was caused in the side gib 42. The motor 90 is adapted, through its associated pulley 88 and the drive belt 86, to turn the fine adjusting pulley 74 on the side gib 40. This causes infinitesimal adjustment within the adjusting screw 52 because of the reduction capabilities between the wave generator 61 and flexspline 63 in the harmonic drive unit 66 associated with the side gib 42.

Thus, there is a coarse adjustment drive to the bottom gib 40 from the second handwheel 83 and to the side gib 42 from the first handwheel 80 through a series of pulleys and belts, which could be replaced by chains and sprockets or gears, or their equivalent; and a motor drive to the side gib 42, through the harmonic drive unit 66 permitting infinitesimal adjustment of the side gib 42. A pulley arrangement could be utilized to permit both the gibs to be operated simultaneously.

The neckrest support 26, prior to its receiving a load, is moved either way along the longitudinal axis of the roll 22 by rotation of the wrench adapter 104, causing the shaft 106 and attached pinion gear 108 to turn. The interaction between the pinion gear 108 and the rack 110 on the side of the inverted-V way 112 permits the motion therebetween, moving the support 26 along the way 14.

Each roll 22 requires a neckrest support 26 on the headstock 34 of the machine 10, and on the footstock 38 of the machine 10. In setting up a machine for grinding, the gibs are backed all the way off prior to installing the roll 22 on the machine 10. The roll 22 is then lowered onto the machine 10, and mounted between the centers 37 in the headstock 34 and the footstock 38. The operator next makes coarse adjustments to the bottom and side gibs 40 and 42 by turning the first and second handwheels 80 and 83 accordingly. The operator then releases the headstock and footstock centers 37, which thereupon transfers the load of the roll to the neckrests 26. The side gib 42 is now given a fine adjustment by the motor 90 to bring the axis of the roll 22 into alignment with the rotational axis machine 10 wherein the roll 22 is ready for its refinishing operation once the chucks are set up.

Though the invention has been described with a certain degree of particularity, it is intended that the specification and appended claims are to be interpreted as exemplary only, and not in a limiting sense.

I claim:

1. A roll grinding machine comprising a bed wherein a cylindrical roll may be longitudinally supported thereover;

at least one neckrest for supporting said roll on said machine, said neckrest including:

a bottom gib disposed on a base member having a longitudinal axis arranged at a first acute angle with respect to a horizontal plane bisecting said roll, said bottom gib being arranged in a direct supportive relationship with respect to said roll;

a side gib disposed on said base member having a longitudinal axis arranged at a second acute angle with respect to said horizontal plane, said side gib being arranged in a direct supportive relationship with respect to said roll; and said base member being movably disposed on an arrangement of ways permitting translational movement of said neckrest parallel to said roll;

said gibs being movable on an axis generally normal to the longitudinal axis of said roll;

said direct supportive relationship of said gibs comprising a linear path between the axis of said roll and a load bearing surface of said ways.

2. A roll grinding machine as recited in claim 1 wherein said movable gib comprises:

a removable housing having a bearing surface disposed on its distal end;

a screw housing having an adjustable screw rotatively disposed therein;

a worm wheel connected to one end of the adjustable screw, and a worm gear in engagement with said worm wheel; wherein rotation of said worm gear causes rotation of said worm wheel and said attached adjustable screw in said screw housing, causing longitudinally directed motion of said screw housing and said attached bearing surface, in a direction normal to the longitudinal axis of the roll supported on said machine.

3. A roll grinding machine as recited in claim 2 wherein one of said movable gibs has a pulley system attached to said worm gear and is linked to another pulley arrangement on said other movable gib, at least one of said pulley systems being adapted to a motor drive and a reduction gear transmission to permit fine adjustments to at least one of said movable gibs, said pulley systems permitting coarse adjustment capabilities to both of said movable gibs.

4. A roll grinding machine comprising a bed wherein a cylindrical roll may be longitudinally supported thereover;

at least one neckrest for supporting said roll on said machine;

said neckrest including:

a threadably adjustable side gib having a bearing surface, said side gib being disposed on a base member, said side gib mounted on said base member so that the contact area of said bearing surface of said side gib engages said roll at a first angle of about 20°–30° below the horizontal plane longitudinally bisecting said roll, said contact area of said side gib being preferably disposed 25° beneath said horizontal plane;

a threadably adjustable bottom gib having a bearing surface, said bottom being disposed on said base member wherein the contact area of said bearing surface of said bottom gib engages said roll at a second angle of about 75°–65° from the horizontal plane longitudinally bisecting said roll, said contact area of said bottom gib preferably being disposed 70° from the horizontal plane bisecting the longitudinal axis of said roll said bottom gib being disposed 80°–90° from said side gib preferably 85° from the corresponding point on said side gib, said base member being disposed at an angle of about 18°–25° with the horizontal, preferably 23° to permit the weight of said roll to be distributed to both of said gibs with a major portion of said weight to be supported by said bottom gib thereby providing stability and adjustability within said neckrest;

said adjustable gibs being mechanically linked to permit simultaneous adjustment thereof.

5. A roll grinding machine as recited in claim 4 wherein at least one of said gibs is infinitesimally adjustable through a reduction gearing system permitting infinitely small movement in said gib toward and away from the axis of rotation of said roll.

* * * * *